US005383400A

United States Patent [19]

Szyszko

[11] Patent Number: 5,383,400

[45] Date of Patent: Jan. 24, 1995

[54] ARTICLE DETECTOR FOR PRINTING PRESS

[75] Inventor: Aleksander Szyszko, Carol Stream, Ill.

[73] Assignee: M & R Printing Equipment, Inc., Glen Ellyn, Ill.

[21] Appl. No.: 591,971

[22] Filed: Oct. 2, 1990

[51] Int. Cl.[6] ..... B41F 15/18

[52] U.S. Cl. ..... 101/126; 101/474; 101/115

[58] Field of Search ..... 101/114, 115, 126, 474, 101/DIG. 30, 123, 124, 129, 283, 284, 322, 233, 234

[56] References Cited

U.S. PATENT DOCUMENTS

| | | | |
|---|---|---|---|
| 3,163,106 | 12/1964 | Failor | 101/6 |
| 4,099,460 | 7/1978 | Bubley et al. | 101/115 X |
| 4,484,070 | 11/1984 | Inoue | 271/265 |
| 4,813,351 | 3/1989 | Pierson, Jr. | 101/115 |

*Primary Examiner*—Edgar S. Burr
*Assistant Examiner*—Christopher A. Bennett
*Attorney, Agent, or Firm*—Wallenstein, Wagner & Hattis, Ltd.

[57] ABSTRACT

An improved printing press of the type having a plurality of beds having a top surface, a flood bar for flooding ink onto a screen placed on one of said plurality of beds, and a squeegee for removing excess ink from the screen, both located at a printing station of the printing press, wherein the improvement comprises a light source, a strip of light reflective material adapted to reflect light generated by the light source, a photoelectric eye for detecting light reflected by the reflective material, and a microprocessor adapted to operatively engage with the photoelectric eye and programmed to sequentially shut off the print station should the photoelectric eye detect reflected light generated by the light source and reflected by the reflective material.

7 Claims, 2 Drawing Sheets

ARTICLE DETECTOR FOR PRINTING PRESS

DESCRIPTION

1. Technical Field of the Invention

The present invention relates to the field of printing. More specifically, the present invention relates to an improvement to a printing press for detecting the presence or absence of an article or workpiece to be printed, and preventing accidental printing in the absence of such article.

2. Background of the Invention

Printed T-shirts and other articles of clothing have become very popular in the last decade. Boutiques which specialize in selling products bearing fanciful indicia such as slogans, college names, or sports team names on T-shirts and other clothing, are commonly seen in shopping malls.

Such fanciful indicia can be printed directly onto articles of clothing. In common use in the industry in printing directly onto articles such as T-shirts is a multi-station, turret type, printing press. The printing press of this type has a plurality of flat beds or platens spaced along its perimeter. Corresponding to each of these beds is a series of stations where a part of the indicia is alternately printed and cured. The number of stations employed depends on the number of colors to be printed on the article. In the past, the number of operators of the press was also determined by the number of colors to be printed on the article. The present press can be easily operated by only two people. Indicia can consist of ten colors or more.

To print onto the article, it is placed on the bed by the operator with the surface to be printed face up. If the article is a T-Shirt, it is slipped over the bed such that the surface to be printed is on the top of the bed. Once printed with the first color, the article must not move or it will be out of registration with the other stations which print the remaining colors.

At the initial station of the typical printing press, the article is printed on the flat bed or platen. The bed is typically made of metal such as aluminum or stainless steel. A screen embodying the indicia to be printed is pre-made using conventional means well-known in the art. The indicia or design is formed in the screen by a conventional process. The screen has interstices in the places where ink of a particular color is to be deposited onto the article to be printed. For each color, a different stencilled screen is used.

The stencil screen embodying the indicia is placed over the article. Ink of one color is then flooded onto the screen by conventional means. The ink is of the type well-known in the industry for screen printing. After the ink is flooded onto the screen, the ink is squeegeed through the screen onto the article leaving ink of the desired color where the interstices in the screen appeared. The squeegee is of any type well-known in the art.

After the excess ink is squeegeed from the screen, the turret type machine is rotated to allow the platen containing the printed clothing to index to the next station where the ink is then dried or cured onto the substrate. Depending on the type of ink used, the ink is either cured on the article by heating it to a critical temperature, or by simply by letting it dry if ink containing solvents is used.

The article to be printed is loaded onto the first station by hand. Often, if the turret printing press is running at high speeds, the operator may not be able to hand load the article to be printed fast enough or the automatic loader may occasionally miss a bed. This causes an empty bed or platen. The automatic loader may also improperly load an article onto the platen. The operator of the press then removes the improperly loaded article from the platen before it is printed. Unless the printing stations are immediately shut off, the machine will print on the empty platen or bed, thereby causing ink to be printed directly onto the platen, and possibly resulting in damage to the screen. As a result, the machine will have to be shut down to clean the platen or bed before it is reloaded with another article. This obviously results in increased down time, thereby increasing production time and costs.

A need has developed for an improved printing press which detects the presence or absence of an article to be printed to prevent unwanted print cycles, thereby eliminating the necessity of stopping the machine to clean a bed which has been accidentally printed. Such elimination will also decrease production costs, and improve efficiency of the printing process. The improved printing press of the present invention solves these and other problems.

SUMMARY OF THE INVENTION

The present invention is an improved printing press of the type having a plurality of beds having a top surface, means for flooding ink onto a screen placed on the bed, and means for removing excess ink from the screen. The improvement comprises means for sensing the presence or absence on the bed of an article to be printed, and means for preventing printing on the bed at all print stations of the printing press in the absence of any article to be printed on the bed.

The sensing means preferably comprises a light source, means for reflecting light generated by the light source, and means for detecting light reflected by the reflecting means. The printing prevention means preferably comprises a microprocessor adapted to operatively engage with said detection means and programmed to sequentially shut off the print station should said detection means detect reflected light generated by said light source and reflected by said reflecting means.

If an article to be printed is on the platen or bed, no light will be reflected from the reflecting means, and the printing press will operate as it normally does, printing the article. If the bed is empty, light will be reflected by the reflecting means and detected by the detecting means. Once detected by the detection means, the absence of article to be printed is sent to a microprocessor programmed to automatically shut off the printing heads at the succeeding stations to which the empty bed is indexed.

The present invention prevents wasted articles due to improper initial loading as the article can merely be pulled from the machine. It also eliminates wasted time and materials in cleaning and possible damage due to printing on a screen and bed having no article on it. The present invention further reduces personnel by allowing the operator to walk from loading station and inspect screens for proper ink quantity. The operator can also leave the machine at the end of a production run as the press will automatically shut down when all pallets are empty.

Other advantages and aspects of the invention will become apparent upon making reference to the specification, claims, and drawings to follow.

DETAILED DESCRIPTION OF THE INVENTION

Figure 1:
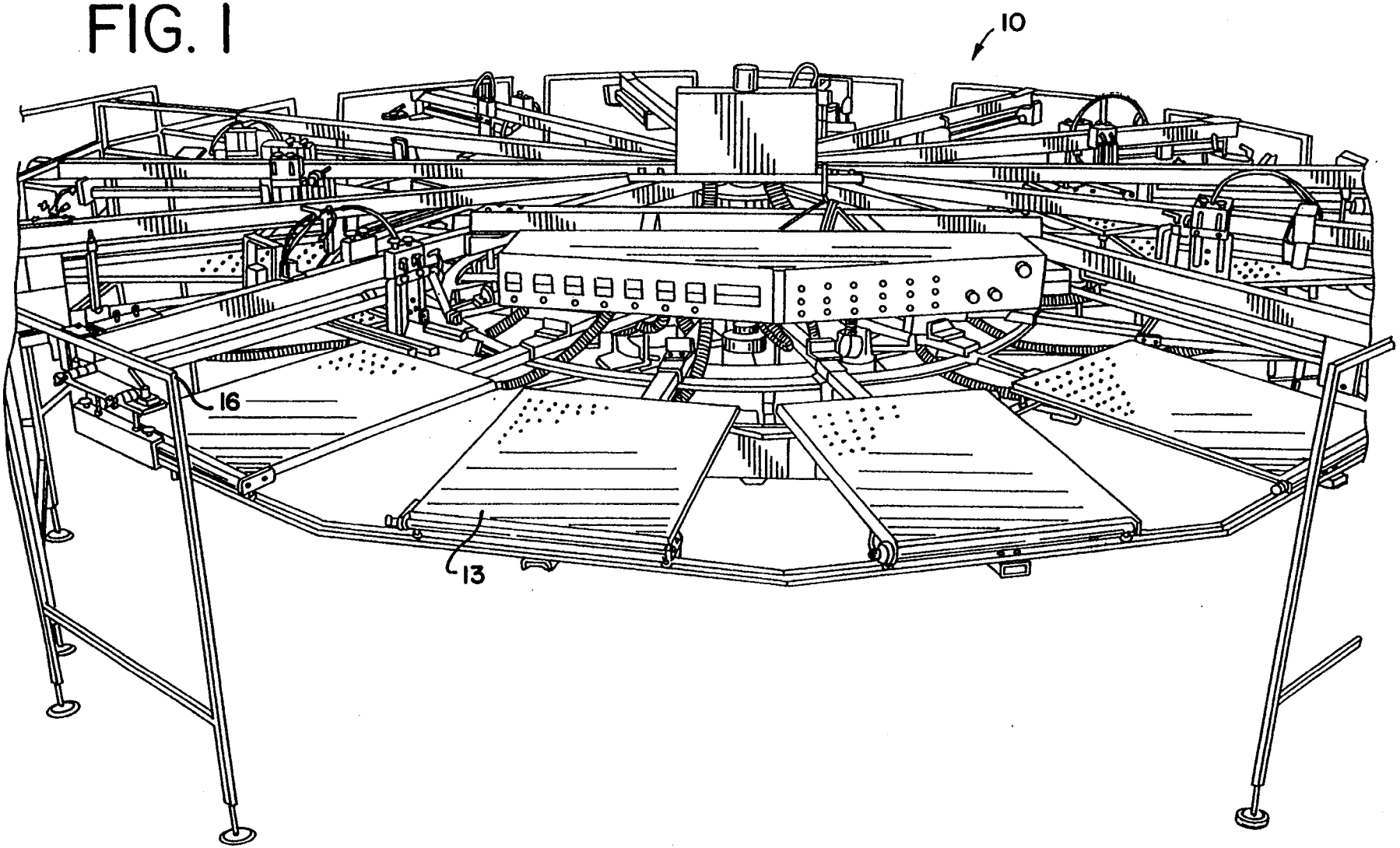
FIG. 1 is a perspective view of the turret-type printing press of the present invention.

While this invention is susceptible of embodiment in many different forms, there is shown in the drawings and will herein be described in detail, a preferred embodiment of the invention with the understanding that the present disclosure is to be considered as an exemplification of the principles of the invention, and is not intended to limit the broad aspect of the invention to the embodiment illustrated.

Referring now to the drawings, FIG. 1 discloses a typical turret-type printing press 10. The press 10 consists of a series of platens or beds 13 spaced along its perimeter. The platens or beds 13 are preferably made of a metal such as aluminum or stainless steel. Corresponding to the beds 13 are a series of stations 16. The stations 16 are designed to print and cure articles. In the middle of the press 10 is a conventional means to rotate the beds 13 between the stations 16 after each print cycle is completed. The loading area is shown in the foreground of FIG. 1.

Figure 2:
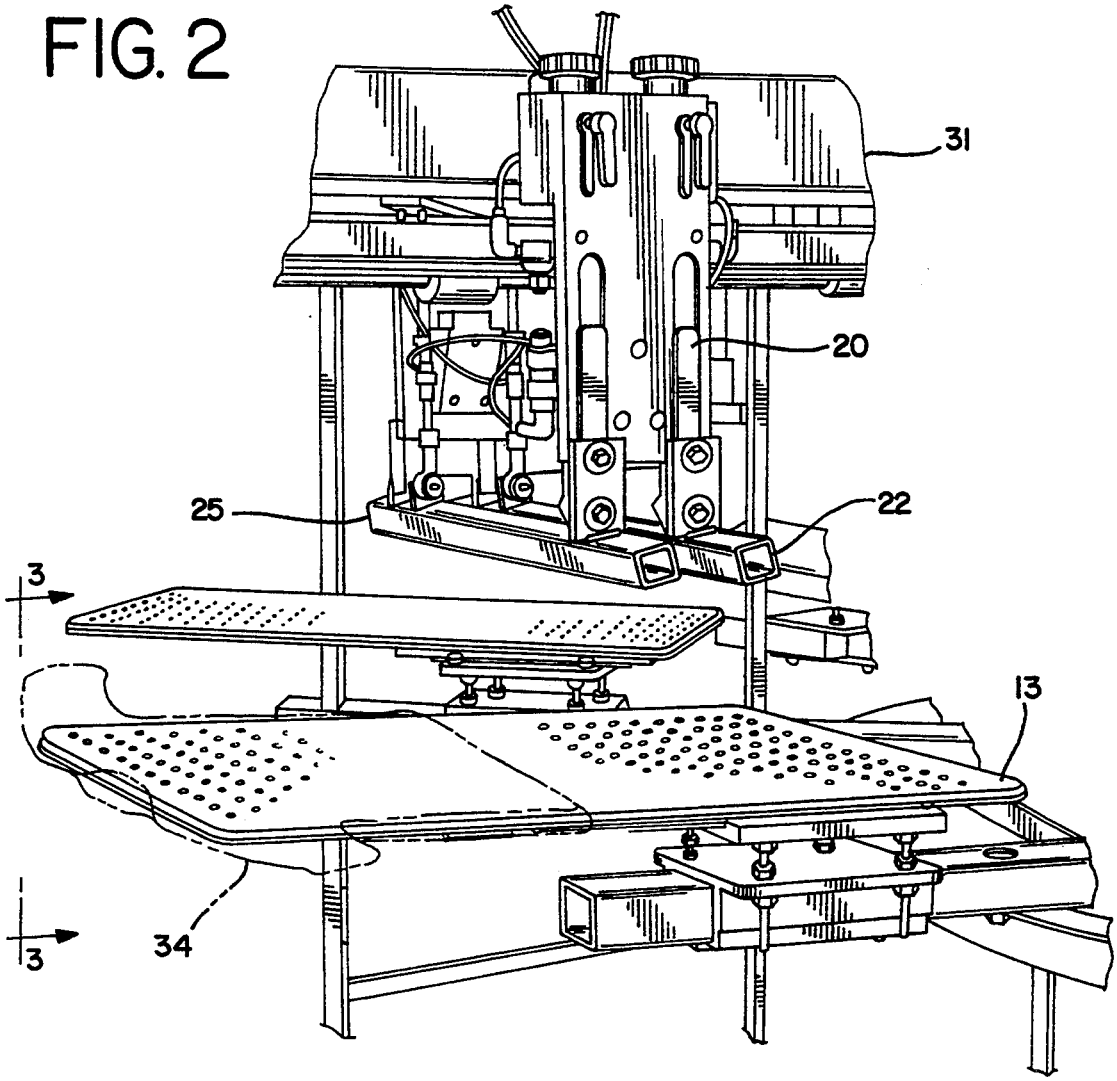
FIG. 2 is an enlarged perspective view of the bed with the flood bar and squeegee holders at the print station illustrated without a screen, as it interacts with the present invention.
Figure 3:
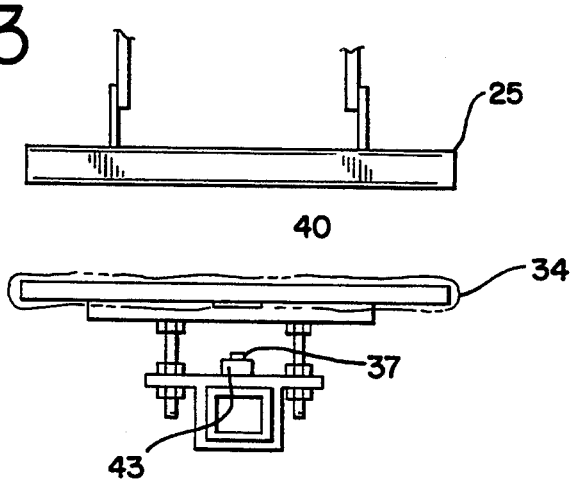
FIG. 3 is a side view of a T-shirt to be printed present on the bed and showing the light source, reflection means and detection means disposed beneath the bed.

FIG. 2 discloses one station 16 of the press 10 designed to print on articles, i.e., a printing station. The station 16 comprises a flood bar 22 and a squeegee 25. The flood bar 22 and squeegee 25 are attached to a housing 28 which slidably engages arm 31. The flood bar 22 and squeegee bar 25 operate to print on an article 34 in a conventional manner. A stencil screen (not shown) which embodies the fanciful indicia is placed on top of the article 34.

A means for curing the ink is typically positioned along the perimeter of the press 10 at a station 16. The drying station is similar to the printing station 16 disclosed in FIG. 2 except that instead of a flood bar 22 and squeegee bar 25, a drying means, preferably comprising a heat source is positioned along the station. The source is directed such that radiation is shed upon the bed 13 and article 34 to heat and cure the ink. If ink containing solvents is used, the drying means is not necessary as the ink is air-dried as the solvents evaporate.

A light source 37 is preferably placed below the bed 13 at an initial station 16. A means 40 for reflecting the light generated by the light source 37 is placed on the underside of each of the beds 13. The reflecting means 40 preferably comprises a strip of light reflective material such as a polished metal. A means 43 for detecting the light reflected by the reflecting means 40 is positioned such that light reflected by the reflecting means 40 is directed to the detecting means 43.

If an article 34 to be printed is present between the reflector 43 and light source 37 on the bed 13, it will block light generated by the light source 37. Thus, no light will reach the reflecting means 40, and no light will be reflected to the detecting means 43. However, if the feeder of articles 34 to be printed misses a bed 13, or if the article 34 is removed as improperly loaded, the bed will be empty and light will be reflected by the reflecting means 40 and detected by the detecting means 43.

Upon detection of light by the detecting means 43, a means for sequentially shutting off the printing stations 16 of the printing press 10 will be activated. The sequential shutoff means (not shown) preferably comprises a microprocessor operatively engaged with the detecting means 43 such that all printing stations to which the empty bed 13 is indexed will not operate. Therefore, accidental printing on the empty bed 13 is prevented.

While the specific embodiments have been illustrated and described, numerous modifications come to mind without significantly departing from the spirit of the invention, and the scope of protection is only limited by the scope of the accompanying claims.

I claim:

1. An improved printing press of the type having a plurality of beds having a top surface, means for flooding ink onto a screen placed on the bed, and means for removing excess ink from the screen both located at a printing station of the printing press, wherein the improvement comprises:

means for sensing the presence or absence on the bed of an article to be printed, said sensing means comprising a light source, means for reflecting light generated by said light source, and means for detecting light reflected by said reflecting means, wherein said light reflective means is adapted to reflect light generated by said light source in the absence of an article to be printed on the bed such that the reflected light is detected by said detection means, said light reflective means being attached to the underside of the bed and said light source and said detection means are positioned generally beneath said reflective means; and means for preventing printing on the bed at all print stations of the printing press in the absence of any article to be printed on the bed.

2. The improved printing press of claim 1 wherein said reflecting means comprises a strip of light reflective material adapted to reflect light generated by said light source.

3. The improved printing press of claim 2 wherein said light reflective material is metal.

4. The improved printing press of claim 1 wherein said detecting means comprises a photoelectric eye.

5. The improved printing press of claim 1 wherein said light source emits infrared light.

6. The improved printing press of claim 1 wherein said printing prevention means comprises a microprocessor adapted to operatively engage with said detection means and programmed to sequentially shut off the print station should said detection means detect reflected light generated by said light source and reflected by said reflecting means.

7. A screen printing apparatus for printing multiple impressions on each of a plurality of work objects in a predetermined sequence comprising:

a plurality of platens for conveying said work objects;

an input station at which work objects are placed on said platens;

a plurality of print stations, each for printing an impression on each work object presented thereto;

means for moving said platen from said input station to said print stations in said predetermined sequence;

means for identifying at least one of said platens as a non-print platen; and control means responsive to said non-print platen identification for inhibiting printing on said at least one non-print platen by each of said print station.

* * * * *